US007047605B2

(12) United States Patent
Kele

(10) Patent No.: US 7,047,605 B2
(45) Date of Patent: May 23, 2006

(54) METHOD AND APPARATUS FOR LIFTING CRYPT LIDS

(75) Inventor: Gavin William Kele, Rockhampton (AU)

(73) Assignee: Rockhampton City Council, Rockhampton (AU)

( * ) Notice: Subject to any disclaimer, the term of this patent is extended or adjusted under 35 U.S.C. 154(b) by 512 days.

(21) Appl. No.: 10/026,626

(22) Filed: Dec. 27, 2001
(Under 37 CFR 1.47)

(65) Prior Publication Data

US 2002/0061247 A1 May 23, 2002

Related U.S. Application Data

(63) Continuation-in-part of application No. 09/117,016, filed as application No. PCT/AU97/00032 on Jan. 21, 1997, now Pat. No. 6,370,745.

(30) Foreign Application Priority Data

Jan. 21, 1996 (AU) ..... PN7653

(51) Int. Cl.
*A61G 19/00* (2006.01)

(52) U.S. Cl. ..... 27/32; 414/460

(58) Field of Classification Search ..... 27/32, 27/35, 27; 414/461, 462, 460; 254/2 R, 254/4 R, 324
See application file for complete search history.

(56) References Cited

U.S. PATENT DOCUMENTS

| | | | | |
|---|---|---|---|---|
| 1,745,051 | A * | 1/1930 | Warren | 254/281 |
| 2,444,690 | A * | 7/1948 | Almendinger et al. | 414/460 |
| 2,562,189 | A * | 7/1951 | Harris | 414/461 |
| 2,750,197 | A * | 6/1956 | Tripp | 280/3 |
| 2,835,955 | A | 5/1958 | Snyder | |
| 2,901,137 | A * | 8/1959 | Emert | 414/460 |
| 3,295,271 | A | 1/1967 | Dorris | |
| 3,372,819 | A * | 3/1968 | Kellogg | 414/461 |
| 3,390,795 | A * | 7/1968 | Mannix | 414/461 |
| 3,878,656 | A | 4/1975 | Duwe et al. | |
| 3,897,663 | A | 8/1975 | Gaul | |
| 4,068,425 | A | 1/1978 | Czorniak | |
| 4,134,239 | A | 1/1979 | Obonaga-Calle | |
| 4,378,958 | A | 4/1983 | Mauldin | |
| 4,433,952 | A * | 2/1984 | Glickman | 414/460 |
| 4,599,030 | A * | 7/1986 | Skaalen et al. | 414/460 |
| 4,604,839 | A | 8/1986 | Esposito | |
| 4,740,131 | A * | 4/1988 | Mayle | 414/460 |
| 4,989,382 | A | 2/1991 | Spronken | |

(Continued)

FOREIGN PATENT DOCUMENTS

| | | |
|---|---|---|
| FR | 2.186.051 | 1/1974 |

(Continued)

*Primary Examiner*—William L. Miller
(74) *Attorney, Agent, or Firm*—Hoffman, Wasson & Gitler PC

(57) ABSTRACT

A vehicle (10) is used to lift the buried lid of a crypt and any soil or turf overlying the lid. The vehicle (10) has a mobile frame (14) which can be positioned over the lid. An attachment frame (11) is suspended from a subframe (12) within the mobile frame (14), the subframe (12) being adjustable laterally relative to the frame (14). The attachment frame (11) has winch cables (19) adapted to be connected to respective attachment fittings on the lid. Hydraulic cylinders (13) are used to raise the attachment frame (11) relative to the mobile frame (14), and thereby lift the lid and any overlying soil/turf. The raised lid can be transported while suspended from the vehicle (10), and subsequently returned for replacement on its crypt in a reverse procedure.

12 Claims, 4 Drawing Sheets

U.S. PATENT DOCUMENTS

| | | | | |
|---|---|---|---|---|
| 5,243,794 | A | 9/1993 | Pikor | |
| 5,287,603 | A | 2/1994 | Schorman | |
| 5,381,591 | A | 1/1995 | Ponger et al. | |
| 5,511,345 | A | 4/1996 | Jones et al. | |
| 5,809,625 | A * | 9/1998 | Young et al. | 27/32 |
| 6,202,985 | B1 | 3/2001 | Chong et al. | |
| 6,324,793 | B1 | 12/2001 | Klanke | |
| 6,419,440 | B1 * | 7/2002 | Smith | 414/460 |

FOREIGN PATENT DOCUMENTS

| | | |
|---|---|---|
| FR | 2.225.993 | 11/1974 |
| FR | 2.444.770 | 7/1980 |
| FR | 2.719.071 | 10/1995 |
| WO | PCT/AU95/00272 | 5/1995 |
| WO | PCT/AU95/00273 | 5/1995 |

* cited by examiner

METHOD AND APPARATUS FOR LIFTING CRYPT LIDS

This application is a continuation-in-part application in respect of my U.S. patent application Ser. No. 09/117016 (hereinafter referred to as "the parent application"), now U.S. Pat. No. 6,370,745.

The subject matter of the parent application and international patent application PCT/AU97/00032 are incorporated herein by reference.

BACKGROUND OF THE INVENTION

The parent application and international patent application PCT/AU97/00032 disclose a burial system in which crypt cells or modules are arranged in a horizontal layer. The crypts are arranged in parallel rows, with the crypts in each row being spaced from each other and staggered relative to crypts in adjacent rows. The crypts are generally of rectangular configuration (when viewed from above), and have truncated vertical corners. At least one vertical corner of each crypt is juxtaposed with the diagonally-opposite corner of a crypt of an adjacent row. The arrangement enables not only the spaces within the respective crypts, but also the spaces between crypts, to be used for burial.

In use, the crypts and the spaces between crypts are covered by respective crypt lids. Each lid may be constructed as a single piece, or may be comprised of two or more sections which are placed side by side to form a lid. The crypt lids are closely spaced to effectively form a generally continuous cover for the burial spaces. A layer of soil is placed over the lids, and turf is normally placed over the soil to form a lawn cemetery, as depicted in FIG. 1 of the parent application.

The crypt arrangement is normally constructed initially in its entirety, at least or in large sections thereof. Thus, after the crypts have been arranged in place, and covered with soil and turf, the burial spaces will initially be empty. Access to the burial spaces will be required at various times, e.g. for interment of deceased persons, retrieval of remains, or inspection.

It is an object of this invention to provide a method and apparatus which facilitate and expedite the process of gaining access to a burial space, and which minimise disruption to the turf and soil overlying adjacent burial spaces.

SUMMARY OF THE INVENTION

In one broad form, this invention provides a vehicle for raising and transporting a crypt lid, the vehicle comprising a main frame supported on spaced ground-engaging elements which locate astride the crypt lid when the vehicle is positioned over the crypt lid, an attachment frame for connection to the lid, the attachment frame being located within the main frame, and a powered lifting mechanism for raising the attachment frame relative to the main frame.

Typically, the vehicle is a trailer, and the ground engaging elements are wheels.

In the preferred embodiment, the attachment frame has a plurality of winches thereon, each having a winch line connectible to a respective attachment fitting on the crypt lid. Each winch line may suitably be provided with a hook for coupling to a respective attachment fitting.

Preferably, the vehicle also has a support frame mounted on the main frame, and slidable on the main frame in a direction transverse to the normal direction of motion of the vehicle. At least one hydraulic cylinder is provided for moving the support frame transversely relative to the main frame. The attachment frame is suspended from the support frame. In this manner, the transverse position of the attachment frame can be adjusted hydraulically.

The attachment frame is typically a rectangular frame, and the powered lifting mechanism may comprise a plurality of hydraulic cylinders, each connected between a respective corner of the rectangular frame and the support frame. These hydraulic cylinders serve not only to suspend the attachment frame from the support frame, but also to raise and lower the attachment frame relative to the support frame and the main frame.

In another form, the invention provides a method of raising a crypt lid which is buried under soil and/or turf, comprising the steps of locating the horizontal position of the crypt lid, placing a template having an outline corresponding to the outline of the crypt lid on the soil/turf directly above the crypt lid, and cutting through the soil/turf around the perimeter of the template, positioning a lid lifting vehicle over the crypt lid, the vehicle having a main frame and an attachment frame located within the main frame, the attachment frame being able to be raised or lowered relative to the main frame, connecting the attachment frame to the crypt lid through the overlying soil/turf, raising the attachment frame relative to the main frame to thereby lift the crypt lid and any soil/turf overlying the crypt lid, and moving the vehicle to a different location with the crypt lid suspended from the attachment frame thereof.

In order the invention may be more fully understood and put into practice, preferred embodiments thereof will now be described with reference to the accompanying drawings.

DESCRIPTION OF PREFERRED EMBODIMENTS

Figure 1:
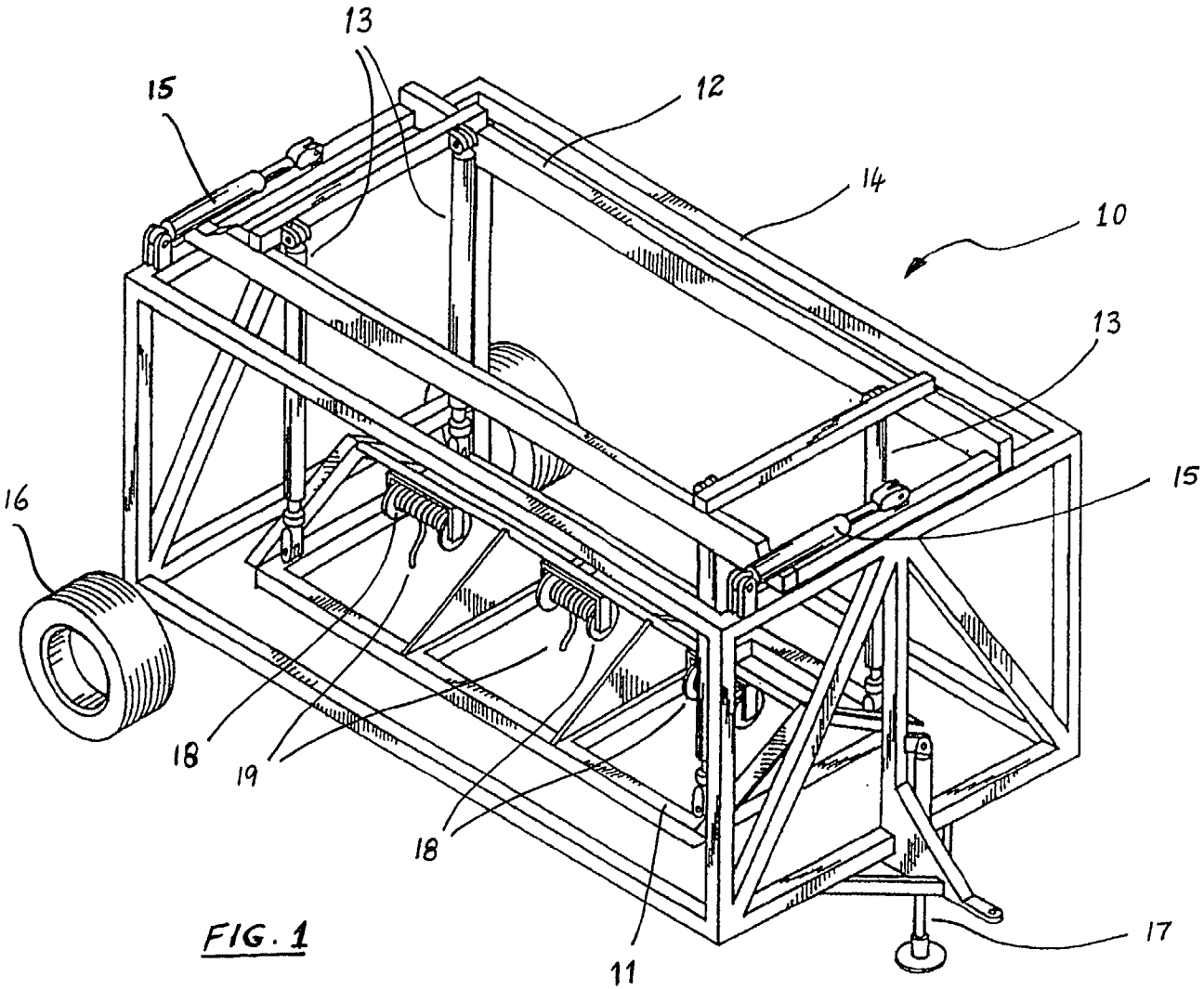
FIG. 1 is a perspective view of a lid lifting vehicle according to one embodiment of the invention.

FIG. 1 illustrates a lid lifting vehicle in the form of a trailer 10 which is suitable for removing and replacing crypt lids, or sections thereof, described in the parent application. The trailer 10 may be mounted on wheels (as shown), tracks or skids, and is typically towed behind a tractor or similar vehicle. Alternatively, the trailer 10 may be self-powered and steerable.

The trailer 10 comprises an attachment frame in the form of a cradle assembly 11 which is suspended from a support frame 12 by four independently controllable hydraulic cylinders 13. The support frame 12 is supported on a main frame 14 of the trailer 11, and can slide therealong. The support frame 12 can be moved laterally relative to the main frame 14 by hydraulic cylinders 15 (i.e. moved transversely to the normal direction of travel of the trailer).

The main frame 14 is supported on a pair of wheels 16 at the rear thereof, and a removable or foldable leg 17 at the front end of the trailer. These are spaced apart sufficiently to straddle a crypt lid.

The cradle assembly 11 is designed to be used with the crypt lids described in the parent application, and has three winches 18 rotatably mounted thereon. Each winch has a cable line 19 wound thereon, and the free end of each cable line 19 may be tied or otherwise secured to a respective attachment fitting on a crypt lid, or respective lid section, as described in the parent application. The winches 18 are spaced apart by the same distances as the attachment fittings on the lids with which the vehicle is intended to be used. It will be appreciated that the number and spacing of the winches 18 can be varied to suit the particular crypt lids with which the lid lifting vehicle is intended to be used.

Figure 2:
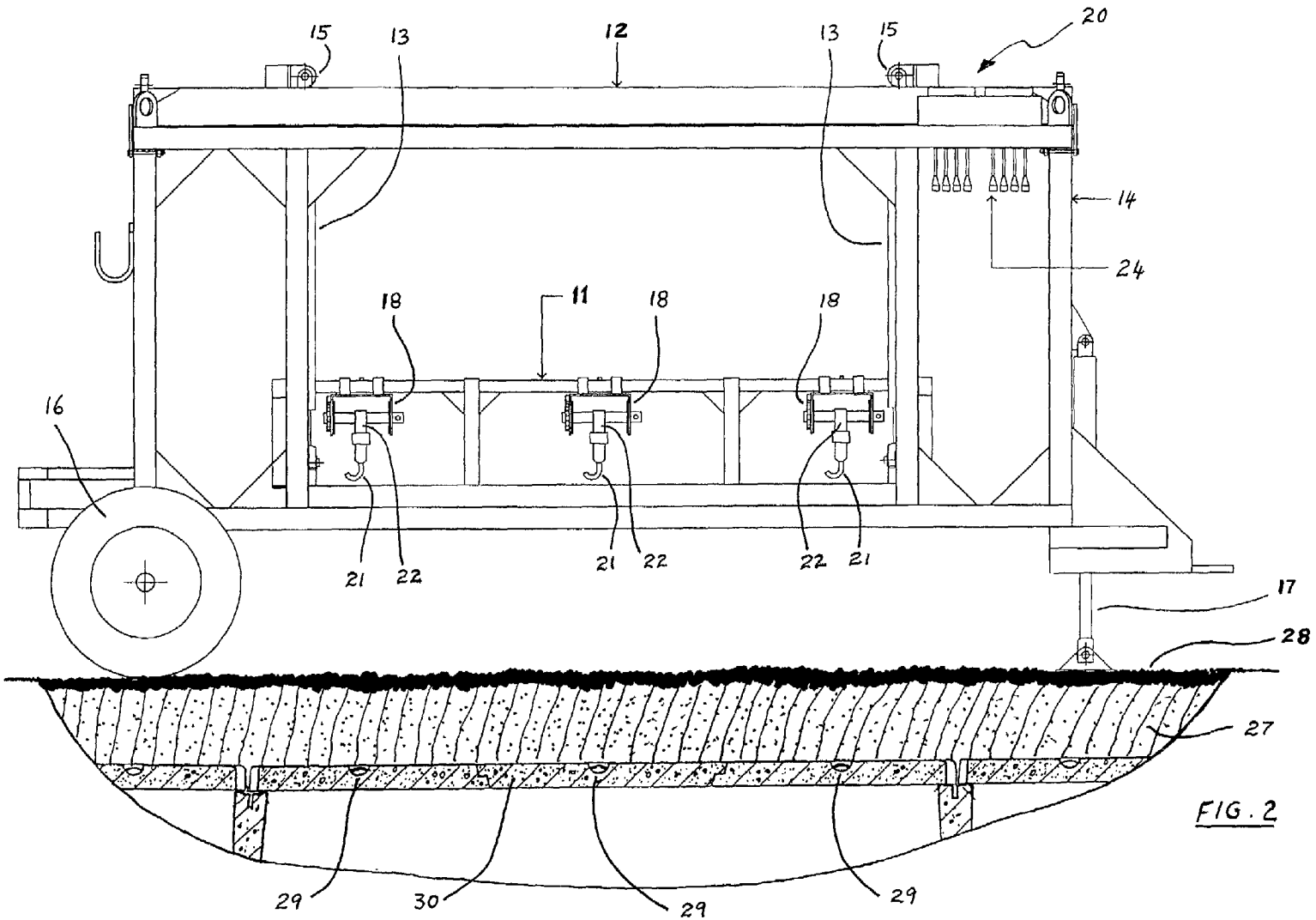
FIG. 2 is a side elevation of a lid lifting vehicle of a second embodiment, in use.
Figure 3:
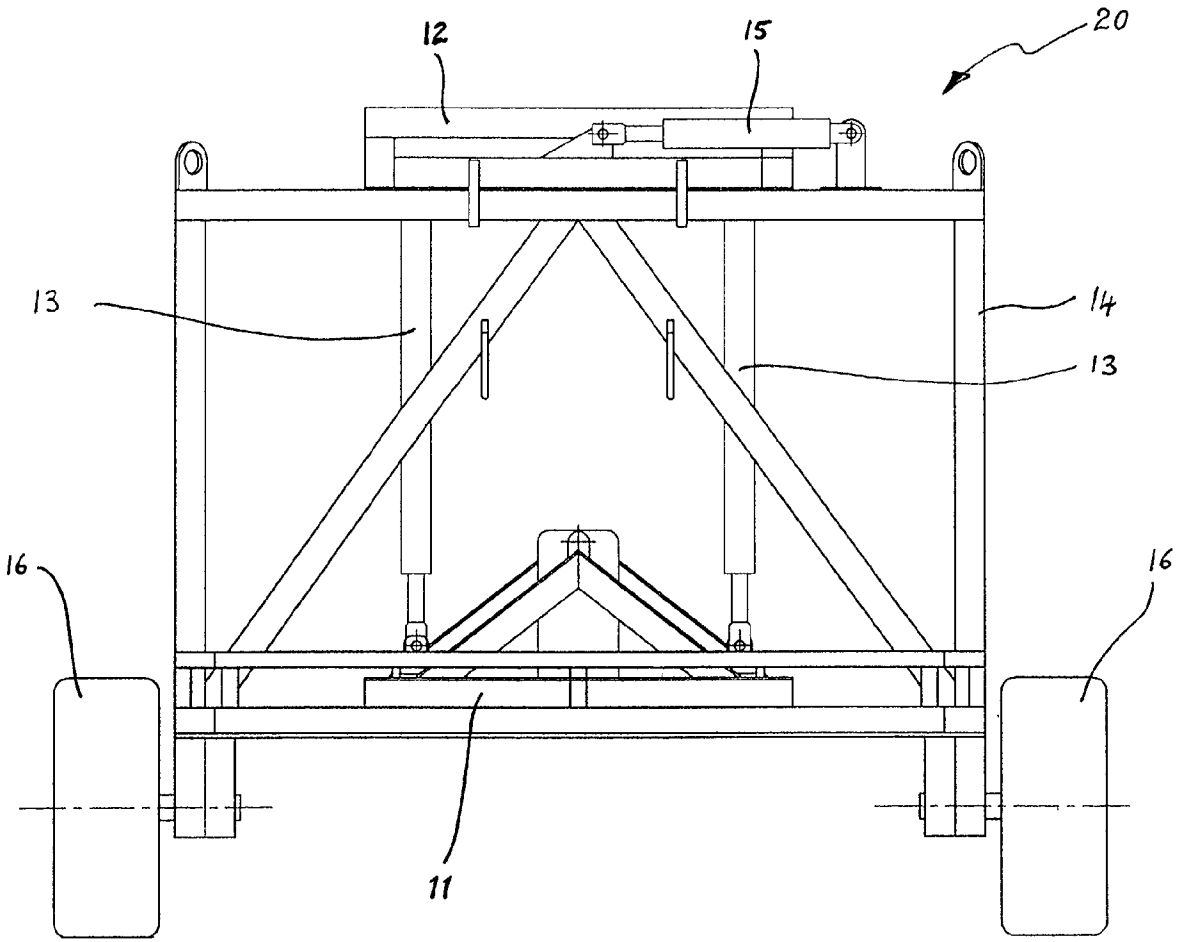
FIG. 3 is an end elevation of the lid lifting vehicle of FIG. 2.

FIGS. 2 and 3 illustrate a slightly modified version of the trailer shown in FIG. 1, and the same reference numerals have been used to denote like components. Instead of the cables 19 shown in FIG. 1, the trailer 20 of FIG. 2 has hooks 21 suspended from straps which are wound upon respective winches 18. FIG. 2 also illustrates the location of control levers 24 for controlling the operation of the hydraulic cylinders 13 and 15.

If access is required to a particular crypt, it is necessary to remove the crypt lid as well as the soil and/or turf covering the lid. Since the crypt lid is concealed by the overlying soil/turf, it must first be located. This can be achieved, for example, by stringline reference from markers on the end crypts in the rows and columns of the crypt arrangement described in the parent application. However, other suitable methods of locating a particular crypt lid may be used.

Figure 4:
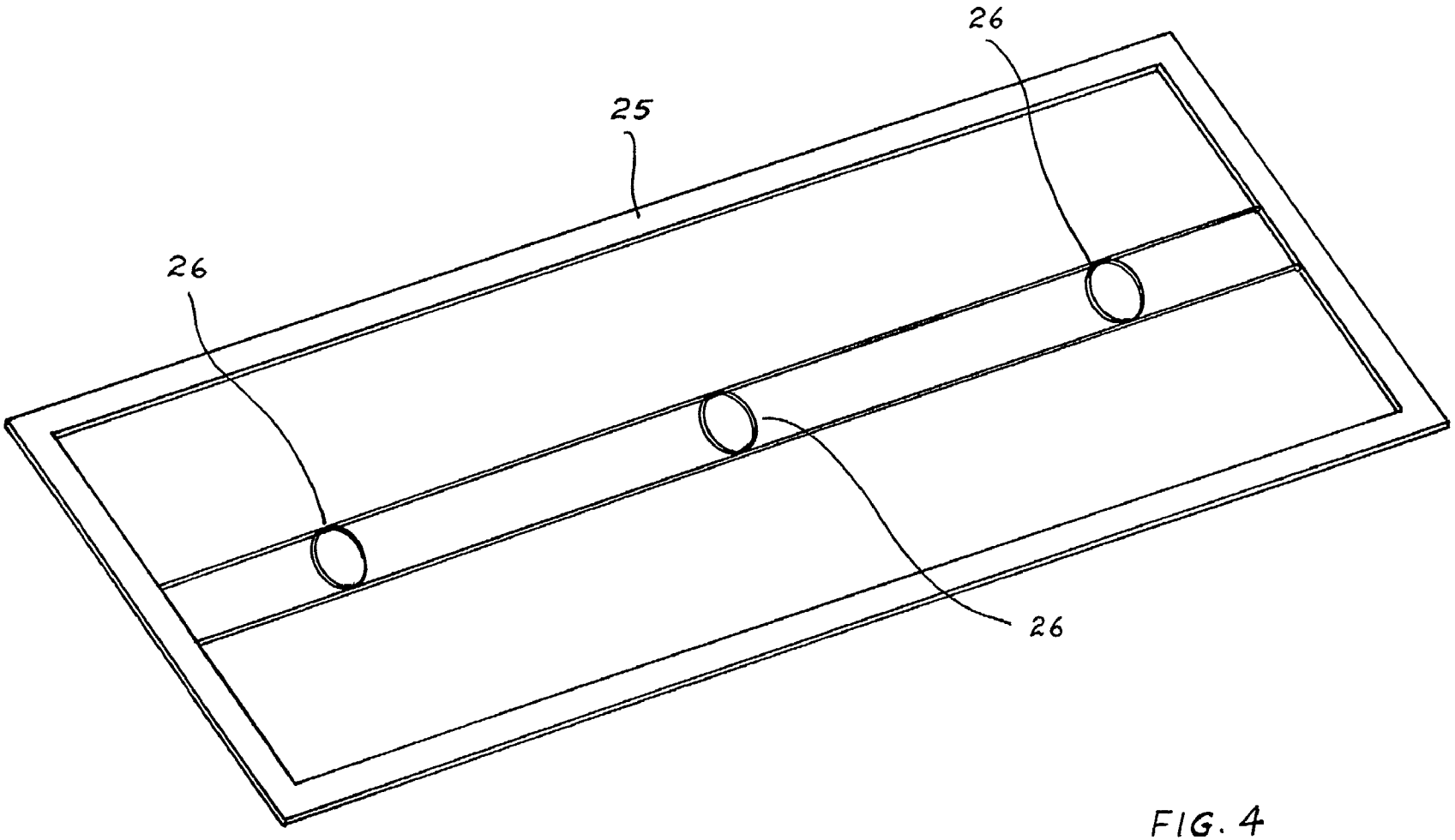
FIG. 4 is a perspective view of a template suitable for use with a lid lifting method according to an embodiment of this invention.

Once the position of the desired crypt lid has been determined, a template is placed on the ground directly above the crypt lid. The template may have reference points which align with the crypt markers. A suitable template is shown in FIG. 4. The illustrated template 25 is a flat rectangular frame whose outer rectangular edge is dimensioned to match the generally rectangular boundary of the crypt lid. The template may suitably be formed of steel or other tough durable material.

The soil/turf is then cut around the outside of the template 25. Suitably, a hydraulically-operated flat spade is used to cut through the soil/turf adjacent the outer rectangular edge of the template 25. This hydraulic spade may be operated from the hydraulic system of the tractor used to tow the trailer 10.

The template 25 is also provided with three reference circles 26 whose positions on the template correspond to the locations of attachment fittings on the crypt lid (or the sections of the crypt lid). Thus, when the template 25 is placed over the crypt lid, the reference circles 26 automatically locate the attachment fittings of the crypt lid, and it is only necessary to remove a small amount of soil directly below the reference circles in order to expose the attachment fittings.

A method of removing a crypt lid will now be described with reference to the embodiment of FIG. 2.

After the crypt has been located, the overlying soil 27 and turf 28 are cut around the template and the attachment fittings 29 are exposed as described above. The trailer 20 is moved into position over the crypt, e.g. by towing it with a tractor. The trailer wheels 16 are positioned astride the crypt lid. By moving the trailer back or forth, it can be positioned longitudinally over the crypt lid. Further, by operating the hydraulic cylinders 15 to shift the support frame 12 laterally, the attachment frame or cradle 11 can be positioned so that the winches 18 thereon are located precisely over respective attachment fittings 29 on the crypt lid 30. The cradle is lowered onto the turf and the hooks 21 are coupled to the exposed attachment fittings 27. The winches 18 are wound to tension the respective winch straps 22 so that the soil/turf is sandwiched between the lid 30 and the cradle 11.

The hydraulic cylinders 13 are then operated by the control levers 24 to raise the cradle 11 which, in turn, lifts the crypt lid 29 together with the overlying soil 27 and turf 28. The template 25 may be left on top of the turf as the crypt lid is raised, or it may be removed once the attachment fittings have been exposed. The crypt lid (or lid sections) may be raised at an angle as the hydraulic cylinders 13 are able to be controlled independently. This assists in freeing stuck edges or corners of the crypt lid or lid sections.

Once the crypt lid (together with overlying soil/turf) is raised to a sufficient height to clear the surrounding ground, the trailer 20 can be towed away (with the crypt lid suspended therein) to permit access to the burial space, e.g. to permit a burial to take place. Due to the natural cohesion of the soil and turf combination, there is usually very little crumbling around the edges of the raised section. The edges of the rectangular aperture formed in the ground are typically protected against crumbling by a suitable frame which supports the coffin during the burial ceremony. Further, or in the alternative, a rectangular frame formed from angle sections can be placed around the edges of the aperture cut in the soil to prevent the soil/turf crumbling at the edges.

After the burial, the trailer 10 carrying the lid and overlying soil/turf can be moved back into position over the burial space. The towing vehicle is used to adjust the position of the cradle 11 longitudinally, while the hydraulic cylinders 15 are used for lateral adjustment of the cradle 11. Once positioned directly over the burial space, the cradle 11 is lowered by operating hydraulic cylinders 13 to replace the lid (with overlying soil/turf)in its original position.

It will be apparent to those skilled in the art that the abovedescribed lid lifting method and apparatus enable a crypt to be opened and closed quickly, with minimum labour requirements and minium disruption to the overlying turf.

The foregoing describes only some embodiments of the invention, and modifications which are obvious to those skilled in the art may be made thereto without departing from the scope of the invention.

For example, the trailer may include a mechanism for longitudinal adjustment of the cradle 11. In such an embodiment, the support frame 12 and hydraulic cylinders 15 are mounted on a subframe which, in turn, is adjustable longitudinally relative to the main frame 14 by hydraulic cylinders.

Further, where a crypt lid consists of separate sections, not all of the lid sections need be raised. Only the section(s) which is(are) required to be raised need be connected to respective winch lines and, after the soil/turf has been cut around such section(s), the connected section(s) can be raised with the attachment frame, the remaining section(s) remaining on the crypt. This is particularly useful for crypt inspections.

The lid-lifting vehicle of this invention can also be used to raise the intermediate lids described in the parent application.

It is to be understood that references to the "crypt" in this specification are intended to include, where the context permits, references to an effective crypt formed by the space between crypt modules.

The invention claimed is:

1. A vehicle for raising and transporting a crypt lid, the vehicle comprising a main frame supported on spaced ground-engaging elements which locate astride the crypt lid when the vehicle is positioned over the crypt lid, an attachment frame for connection to the lid, the attachment frame being located within the main frame, and a powered lifting mechanism for raising the attachment frame relative to the main frame, wherein the attachment frame has a plurality of winches thereon, each having a winch line connectible to a respective attachment fitting on the crypt lid, further comprising a support frame mounted on the main frame and slidable therealong in a direction transverse to the direction of motion of the vehicle, and at least one hydraulic cylinder for moving the support frame transversely relative to main frame, the attachment frame being suspended from the support frame.

2. A vehicle as claimed in claim 1, wherein each winch line has a hook at the free end thereof.

3. A vehicle as claimed in claim 1, wherein the attachment frame comprises a generally horizontal rectangular frame, and the powered lifting mechanism comprises a plurality of hydraulic cylinders, each connected between a respective corner of the rectangular frame and the support frame.

4. A vehicle as claimed in claim 1, wherein the vehicle is a trailer and the ground-engaging elements are wheels.

5. A lid lifting vehicle for raising and transporting a crypt lid, the vehicle comprising a main frame of generally rectangular configuration when viewed from above, and having a longitudinal axis, a support frame mounted on the main frame, and adjustable relative to the main frame in a direction transverse to the longitudinal axis, an attachment frame dependent from the support frame, the attachment frame having connectors thereon for connection to respective attachment fittings on the crypt lid, and means for raising and lowering the attachment frame relative to the support frame and within the main frame, to thereby raise or lower the crypt lid when connected to the attachment frame.

6. A vehicle as claimed in claim 5, wherein the connectors comprise winch cables wound on respective winches, and having their free ends adapted to be connected to the attachment fittings.

7. A method of raising a crypt lid which is buried under soil and/or turf, comprising the steps of locating the horizontal position of the crypt lid, placing a template having an outline corresponding to the outline of the crypt lid on the soil/turf directly above the crypt lid, and cutting through the soil/turf around the perimeter of the template, positioning a lid lifting vehicle over the crypt lid, the vehicle having a main frame and an attachment frame located within the main frame, the attachment frame being able to be raised or lowered relative to the main frame, connecting the attachment frame to the crypt lid through the overlying soil/turf, raising the attachment frame relative to the main frame to thereby lift the crypt lid and any soil/turf overlying the crypt lid, and moving the vehicle to a different location with the crypt lid suspended from the attachment frame thereof.

8. A method as claimed in claim 7, wherein the attachment frame has a plurality of winches, each having a cable wound thereon, and the step of connecting the attachment frame to the crypt lid comprises connecting the winch cables to respective attachment fittings on the crypt lid.

9. A method as claimed in claim 7 wherein the attachment frame is suspended from a support frame by hydraulic cylinders, the support frame being supported on the main frame and moveable laterally relative to the main frame, further comprising the step of adjusting the lateral position of the support frame relative to the main frame to locate the attachment frame over the crypt lid.

10. A method as claimed in claim 9, wherein the step of raising the attachment frame comprises lifting the attachment frame using the hydraulic cylinders.

11. A vehicle for raising and transporting a crypt lid, the vehicle comprising a main frame supported on spaced ground-engaging elements which locate astride the crypt lid when the vehicle is positioned over the crypt lid, an attachment frame for connection to the lid, the attachment frame being located within the main frame, and a powered lifting mechanism for raising the attachment frame relative to the main frame, and a support frame mounted on the main frame and slidable therealong in a direction transverse to the direction of motion of the vehicle, and at least one hydraulic cylinder for moving the support frame transversely relative to main frame, the attachment frame being suspended from the support frame.

12. A vehicle as claimed in claim 11, wherein the attachment frame comprises a generally horizontal rectangular frame, and the powered lifting mechanism comprises a plurality of hydraulic cylinders, each connected between a respective corner of the rectangular frame and the support frame.

* * * * *